US005596677A

United States Patent [19]

Jarvinen et al.

[11] Patent Number: 5,596,677

[45] Date of Patent: Jan. 21, 1997

[54] METHODS AND APPARATUS FOR CODING A SPEECH SIGNAL USING VARIABLE ORDER FILTERING

[75] Inventors: Kari Jarvinen; Olli Ali-Yrkko, both of Tampere, Finland

[73] Assignee: Nokia Mobile Phones Ltd., Salo, Finland

[21] Appl. No.: 155,574

[22] Filed: Nov. 19, 1993

[30] Foreign Application Priority Data

Nov. 26, 1992 [FI] Finland ..... 925376

[51] Int. Cl.[6] ..... G10L 3/02

[52] U.S. Cl. ..... 395/2.29; 395/2.28; 395/2.38

[58] Field of Search ..... 395/2.28, 2.29, 395/2.32, 2.38, 2.32

[56] References Cited

U.S. PATENT DOCUMENTS

| | | | |
|---|---|---|---|
| 4,618,982 | 10/1986 | Horvath et al. | 395/2.28 |
| 4,969,192 | 11/1990 | Chen et al. | 381/31 |
| 5,138,662 | 8/1992 | Amano et al. | 381/36 |
| 5,235,669 | 8/1993 | Ordentlitch et al. | 395/2 |
| 5,265,167 | 11/1993 | Akamine et al. | 381/40 |
| 5,327,519 | 7/1994 | Haggvist et al. | 395/2.28 |
| 5,406,635 | 4/1995 | Jarvinen | 381/94 |
| 5,432,884 | 7/1995 | Kapanen et al. | 395/2.37 |

FOREIGN PATENT DOCUMENTS

| | | | |
|---|---|---|---|
| 0154381A2 | 9/1985 | European Pat. Off. . | |
| 0266620A1 | 5/1988 | European Pat. Off. . | |
| 0316112A2 | 5/1989 | European Pat. Off. | G10L 5/06 |
| 0361432A2 | 4/1990 | European Pat. Off. . | |
| 0375551A2 | 6/1990 | European Pat. Off. | G10L 9/14 |
| 0379296A2 | 7/1990 | European Pat. Off. | G10L 9/14 |
| 0401452A1 | 12/1990 | European Pat. Off. | G10L 9/14 |
| WO92/22891 | 12/1992 | WIPO | G10L 9/14 |

OTHER PUBLICATIONS

Signal compression based on models of human perception Jayant et al., IEEE/Oct. 1993.

Subband vector excitation coding with adaptive bit-allocation Yong et al., IEEE, /May 1989.

Adaptive bit-allocation between the pole-zero synthesis filter and excitation in CELP Miseki et al., IEEE/May 1991.

"Frame Substitution And Adaptive Post-Filtering In Speech Coding", Daniele Sereno, p. 595-598.

*Primary Examiner*—Allen R. MacDonald
*Assistant Examiner*—Richemond Dorvil
*Attorney, Agent, or Firm*—Perman & Green

[57] ABSTRACT

The method concerns digital coding of a speech signal. The method is based on the use of a model of speech production comprising an excitation and shaping of the excitation in a filtering operation in such a manner that the order of the filtering which models the shaping of the excitation signal occurring in the vocal tract is adapted according to the speech signal to be coded. By means of the method it is possible to achieve a total modelling for the speech signal—and thus efficient speech coding—which is better than methods using fixed-order, model-based filtering of the speech tract. From the standpoint of the efficiency of the coding, by decreasing a needlessly large order of the filtering method, the bit rate to be used for coding the excitation signal can be increased or the bit rate resources thus freed up can be allocated for use in the error correction coding. On the other hand, the order of the filtering operation modelling the vocal tract can if necessary be increased if this is of essential benefit in the coding, and correspondingly, the bit rate to be used in coding the excitation signal can be lowered.

15 Claims, 6 Drawing Sheets

METHODS AND APPARATUS FOR CODING A SPEECH SIGNAL USING VARIABLE ORDER FILTERING

The present invention relates to a method of coding a speech signal.

BACKGROUND OF THE INVENTION

In the digital coding of speech, a two-part model based on human speech production is often used, this incorporating first the formation of an excitation (in human beings: the vibration of the vocal cords or a stricture point in the vocal tract) and the shaping occurring in the vocal tract). The filtering operation that is used in a speech coder to model the shaping of the vocal tract is generally termed so-called short-term filtering or short-term modelling. For the efficient coding of an excitation signal, various methods and models have been developed, which have succeeded in lowering the bit rate required to transmit the excitation signal without, however, significantly impairing the quality of the speech signal. At present the most effective speech coding methods have proved to be speech coders that employ the analysis-by-synthesis method in searching for a representation of the excitation signal, which representation can be transmitted at the smallest possible bit rate, a notable example being the method of Code Excited Linear Prediction, see, for example U.S. Pat. No. 4,817,157. Effective methods have also been developed for coding the parameters of a short-term filtering model, such as, for example, transmission in the Line Spectrum Pair format (see the publication F. K. Soong, B. H. Juang: "Optimal quantization of LSP parameters using delayed decisions", Proceedings of the 1990 International Conference on Acoustics, Speech and Signal Processing).

Although efficient methods have been developed for transmitting both an excitation signal and a filtering model, the previously presented methods have not taken into account the fact that the shaping performed on different sounds in the vocal tract is different in type for different types of sounds and thus it can be modelled in different ways in a short-term filter. For this reason, in order to achieve speech coding that is as efficient as possible, the order of the filtering should be adapted according to the speech signal to be coded. In methods previously known in the field, fixed-order filter modelling has meant that there has been in use an order or modelling which for un-voiced sounds (consonants) is needlessly large for conveying their relatively evenly distributed spectral curve, and the resources used for this order of modelling could be better utilized in coding the excitation signal or in error correction coding. On the other hand, where voiced sounds are involved, the use of a fixed-order easily leads to the use of an excessively low-order filtering model even though the modelling of the formant structure of the spectrum of voiced sounds could be made significantly more efficient by using a larger order of modelling.

SUMMARY OF THE INVENTION

According to the present invention there is provided a method of coding an input signal comprising a series of speech signal blocks, the method comprising the steps of:

a) developing, in a short-term analyzer, a group of prediction parameters, characteristic of the input signal, in which each speech signal block to be coded, is characteristic of the speech signal's short-term spectrum;

b) forming an excitation signal which, when fed to the synthesis filter operating in accordance with the prediction parameters, results in the synthesis of a coded speech signal corresponding to the original input signal, c) a short-term filtering model is formed from two components of a fixed-order, a low-order component and a component which has a variable order and makes possible an order of high modelling;

d) calculating the short-term prediction parameters for both components;

e) adapting the total order of the short-term model in each speech block to be coded, in accordance with the speech signal; and f) adapting the bit rate to be used for coding the parameters of the filter model and the transmission to be used for coding the excitation signal in such a manner that increasing the order to be used in the modelling increases the bit rate of the model's parameters and, correspondingly, reduces the bit rate to be used for coding the excitation.

An advantage of the present invention is the creation of a method of digital coding of a speech signal by means of which the above-presented deficiencies and problems can be solved. Thus, the order of short-term modelling is first adjusted adaptively according to the speech signal and, on the other hand, the ratio to each other of the bit rates of the parameters describing the excitation signal and the short-term filtering are adapted according to the speech signal. From the standpoint of the coding efficiency, by reducing the needlessly large order of the filtering model, the bit rate to be used for coding the excitation signal can be increased or the bit rate resources thus freed up can be put to use in the error correction coding. On the other hand, the order of the filtering operation modelling the vocal tract can, if necessary, be increased if this is of substantial benefit in the coding and, correspondingly, the bit rate used in coding the excitation signal can be lowered. The method can be used for both coding methods that code the modelling error directly and for analysis by synthesis methods which make use of closed-loop optimization of the excitation signal in the coding. In the last-mentioned methods if is possible to avoid the use of an excessively large order of modelling for the sound to be modelled by adapting the order in accordance with the invention, and this allows the computational load to be lowered substantially. Use of the method yields an overall modelling of the speech signal which is better than models employing fixed-order model-based filtering of the vocal tract, and this results in efficient speech coding.

BRIEF DESCRIPTION OF THE DRAWINGS

Embodiments of the invention are described below, by way of examples with reference to the accompanying drawings in which.

DETAILED DESCRIPTION OF THE INVENTION

Figures 1A, 1B, 1C, 1D, 1E, 1F:
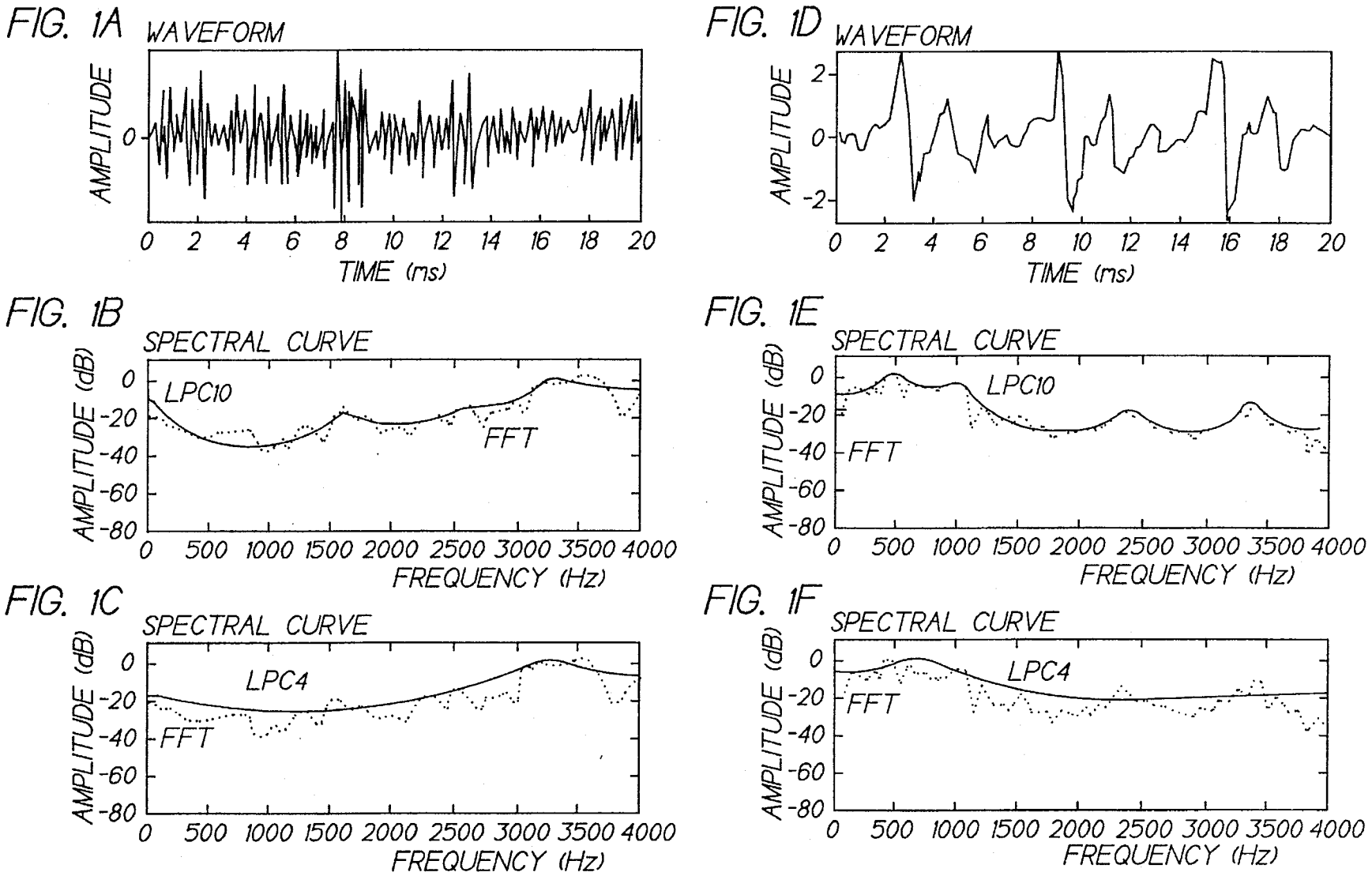
FIGS. 1*a*–1*f* illustrate the operation of the modelling of the short-term prediction filter with different orders of modelling for two different types of sounds, the phonemes /s/ (FIGS. 1*a*–1*c*) and /o/ (FIGS. 1*d*–1*f*)

Described in greater detail, in the method in accordance with the invention a short-term filtering model is used which is formed of two parts, i.e., a low-degree fixed-order component and an adaptable-order component. The latter mentioned adaptable-order component makes it possible to achieve, if necessary, a high order of overall modelling. For both of these prediction models, the short-term prediction parameters are calculated separately and the calculation of the filter coefficients of both models can be carried out with any method known in the field, for example, in connection with linear modelling with a computational algorithm based on Linear Predictive Coding, LPC. The values of the modelling parameters according to both models are adapted, i.e., they are calculated from the speech signal at intervals of approx. 10–40 ms. Calculation of the filter coefficients of the fixed-order, short-term filter model is carried out directly from the speech signal that is input for coding, whereas the filter coefficients of the adaptable-order, short-term model are calculated from the signal which is obtained by filtering the speech signal input for coding with the inverse filter of the fixed-order model. The fixed-order, low-order model thus acts as a prefiltering function for the adaptable-order modelling. Since the modelling makes use of a separate low-order filter, different kinds of adaption frequencies of the model's parameters can be used in the fixed-order and adaptable-order filter. The filter parameters for the two short-term models mentioned can thus be sent to the receiver at various intervals. By means of fixed-order modelling it is thus possible to convey in an efficient manner spectral characteristics which are due to the speaker and the microphone, which change slowly that and are fairly well suited to low-order modelling, this being accomplished in such a way that the coefficients of the modelling are adapted less frequently than the coefficients of the adaptable-order modelling, which contain rapidly changing phonic information.

In another embodiment of the invention, which operates on an 8 kHz sampling frequency, the order of the adaptable-order, short-term modelling is adjusted according to the results of the fixed-order modelling as follows: the order in the filter with adaptive filter order is set to a small value (approx. the 2nd order) if most of the energy in the signal block to be coded lies in the high frequencies, i.e., if the frequency response obtained on the fixed-order modelling is of the high-pass type (an un-voiced type of sound that is classified as easy to model). The order of the adaptable-order modelling in turn is set to a large value (approx. the 12th order) if the frequency response of the signal obtained in the fixed-order modelling is of the low-pass type (a voiced type of sound that is classified as containing a meaning-carrying format structure). The order of the fixed-order modelling is constant and it has a second order of magnitude. With the orders given in this example, the resulting order for the total modelling is either 4 or 14.

In yet another embodiment, the order of the filter modelling is adapted according to the success of the modelling by means of feedback on the basis of the modelling error signal. In this embodiment, setting of the order can be carried out steplessly without making a rough decision based on the two different modelling orders.

FIGS. 1*a*–1*f* illustrate the operation of the short-term modelling with different degrees of modelling for two different types of sounds, i.e., the un-voiced /s/ phoneme and the voiced /o/ phoneme. The sample-taking frequency used was 8 kHz. FIG. 1*a* presents the waveform and FIGS. 1*b* and 1*c* the spectral curve (dashed line) of the /s/ phoneme belonging to the un-voiced type of sounds as calculated with the FFT method (Fast Fourier Transform). FIGS. 1*b* and 1*c* present the frequency response of the short-term LPC modelling with two different orders of modelling, 4 and 10 (LPC4 and LPC10). Correspondingly, FIG. 1*d* presents the waveform and FIGS. 1*e* and 1*f* the FFT spectral curve of the voiced /o/ phoneme as well as the frequency response of the short-term LPC modelling with two orders of modelling, 4 and 10 (LPC4 and LPC10). The 4th order model used (LPC4) is capable of modelling quite well the relatively even frequency content presented, which is typical of an un-voiced sound. On the other hand, it is only with a greater order of modelling that the resonance points of the spectrum, which are important in the interpretation of voiced sounds, can be conveyed well. For example, the spectral curve of the /o/ phoneme, which is formed of four resonance peaks, can be modelled properly only with a higher order, say, a 10th order model (LPC10), as is shown in FIG. 1*e*. Resonance peaks, or so-called formants, can be distinguished clearly from the LPC10 curve at frequencies of approx. 500 Hz, 1000 Hz, 2400 Hz and 3400 Hz. In the modelling of the /s/ phoneme presented in FIG. 1*a*, increasing the order of modelling to 10 in FIG. 1*b* does not bring a corresponding substantive improvement in the modelling.

Figure 2A:
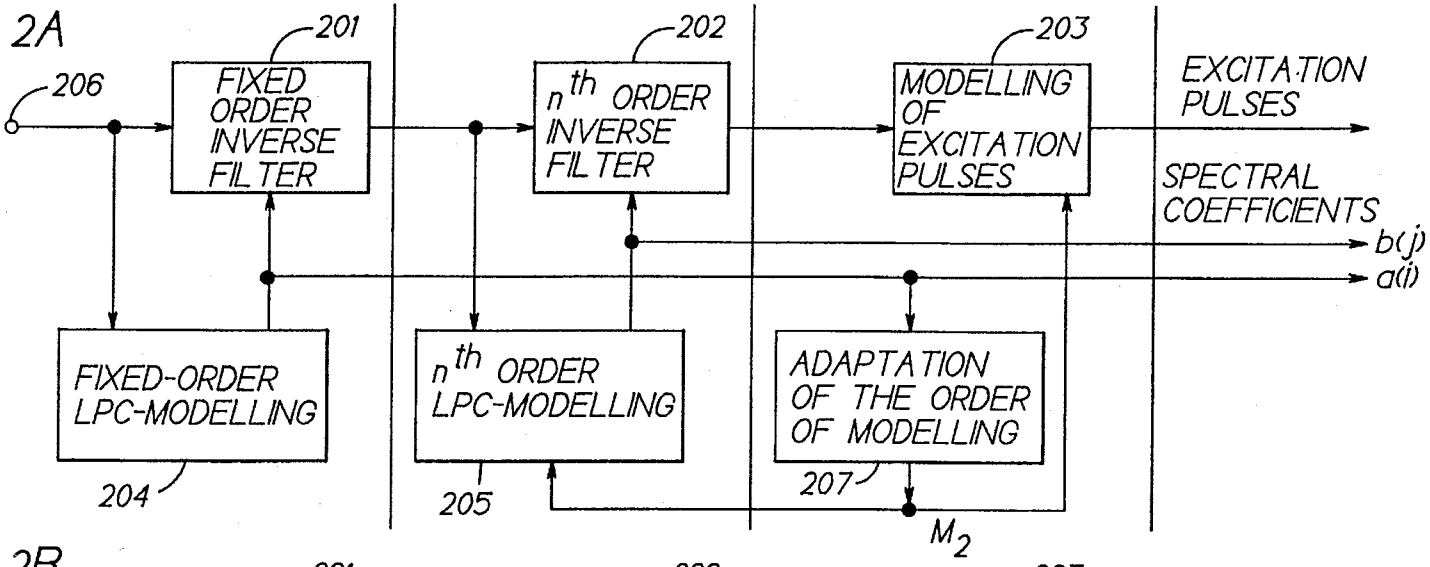
FIGS. 2*a*–2*c* illustrate an encoder used in a method in accordance with the invention as follows: adaption of the order of the overall modelling on the basis of the coefficients of low-order modelling (FIG. 2*a*), adaption of the order of modelling by means of the overall modelling error (FIG. 2*b*) and adaption of the bit rate of the error correction coding according to the order of the modelling (FIG. 2*c*)
Figure 2B:
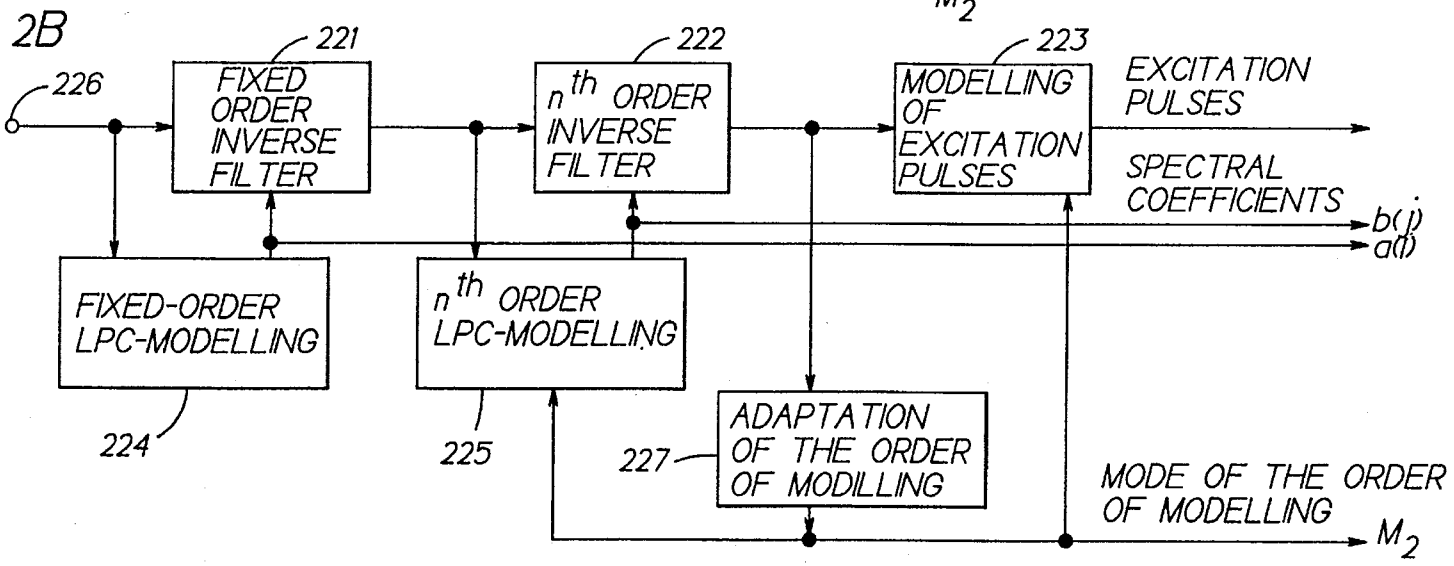
Figure 2C:
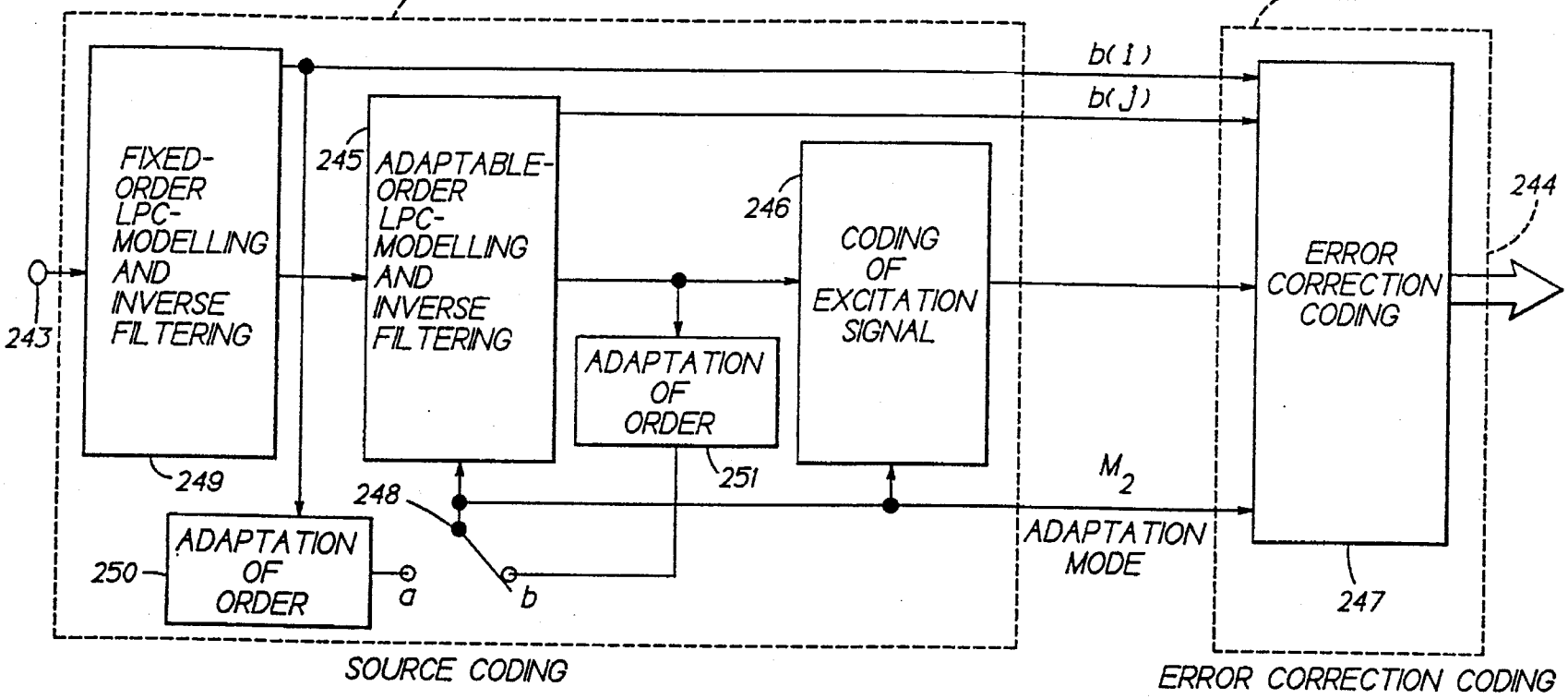

FIGS. 2*a*–2*c* illustrate an encoder of the coding method, which encoder forms an excitation signal directly from the error signal of the short-term modelling, said encoder using adaption of the order of the short-term filtering modelling in accordance with the invention. FIG. 2*a* presents an embodiment of the encoder, in which adaption of the order is carried out based on the coefficients of the fixed-order model. Speech signal 206 first goes through the low-order, short-term modelling 204 in which the filter coefficients a(i); i=1,2, . . . $M_1$ corresponding to the model are formed. These can be either coefficients of the direct-form filter or so-called reflection coefficients, which are used in lattice filters. The operation to be carried out in block 204 can be accomplished with any known computational method for the filter coefficients of a linear prediction model. $M_1$ has a constant value and its magnitude is typically of the order 2. Speech signal 206 is input to inverse filter 201, which is in accordance with the calculated model and has the order $M_1$.

The signal obtained from the fixed-order inverse filter 201 (i.e., the prediction error or the fixed-order model) is then input to the adaptable-order inverse filter 202. In the embodiment in the figure, a decision is made, on the basis of the filter coefficients a(i); i=1,2, . . . $M_1$ in block 207, on the magnitude of the order $M_2$ of the adaptable-order modelling 205 by means of the method described below. The filter coefficients b(j)=1,2, . . . $M_2$ of adaptable-order filter 202 are calculated in block 205. The search for a suitable coded format for the prediction error of the total modelling is carried out in coding block 203. The excitation pulses thus formed, which convey the prediction error, are sent to the decoder to be used as an excitation signal. Apart from the excitation pulses, the filter coefficients of both the low fixed-order modelling and the adaptable-order modelling are also sent to the receiver. If in block 207 a decision is made to use a small order of modelling in the adaptable-order modelling 205, the resources that are freed up from this modelling are used for coding the overall modelling error, which is to be carried out in block 203. In block 203 the coding of the modelling error can be carried out with any method known in the field, for example, with a method based on limiting the amount of samples (see, e.g., the publication P. Vary, K. Hellwig, R. Hofman, R. J. Sluyter, C. Galand, M. Rosso: "Speech codes for the European mobile radio system", Proceedings of the 1988 International Conference on Acoustics, Speech, and Signal Processing). If, on the other hand, it is observed that a large order of modelling is needed for the short-term modelling, part of the resources that are to be used otherwise for coding the excitation signal can be directed to supply parameters of the short-term model, in which case the order of short-term modelling can be increased. This is done by raising the order used in the adaptable-order modelling.

In the embodiment shown in FIG. 2*a*, the decision on the order of the filtering model to be used is made in adaption block 207 according to the following procedure: if the fixed-order modelling that has been carried out shows that the largest part of the energy which input signal 206 contains is in the low frequencies, the method makes use of a large order in the short-term modeling. If, on the other hand, the energy in the signal has built up around the high frequencies, low-order modelling is used. Interpreted in its simplest form, the model is based on the fact that the spectral envelope of un-voiced sounds, which are weighted towards the high frequencies, does not contain, in the manner of voiced sounds, clear spectral peaks conveying essential information, in which case for un-voiced sounds a lower short-term modelling can be used and a greater part of the transmission capacity can be directed towards coding the excitation signal. On the other hand, in the case of voiced sounds, there is reason to use a high order filter model to convey the spectral envelope so that the formant structure which is important for them can be conveyed as precisely as possible in the coding method. In the method shown in FIG. 2*a*, two different overall modelling orders can be used, i.e., a low one for sounds classified as un-voiced (of the order of 4) and a high one for sounds classified as voided (of the order of 12).

FIG. 2*b* presents another exemplary embodiment for implementing the procedure in accordance with the invention in a digital speech coder. Compared with FIG. 2*a*, the difference lies in the adaption of the order of modelling directly on the basis of the prediction error of the overall modelling by means of feedback and not on the basis of the low-order filter coefficients. The adaption of order $M_2$ is carried out in block 227 of the figure on the basis of the actual prediction error, whereas in block 207 the adaption is based on the filtering coefficients of the fixed-order modelling by means of the procedure previously discussed. In the example in FIG. 2*b*, the adaption of the order of modelling to be carried out in block 227 is performed according to the prediction error by comparing the effect of increasing the order of modelling on the prediction error. The method involves increasing the order of modelling until the increase produces a reduction in the power of the predicted error signal, which is smaller than a predetermined threshold value $P_{TH}$. In this case it can be deduced that it is needless to increase the order of the modelling still further, and the order of modelling at that moment is selected for use. In the method the speech signal that has been processed in the fixed-order inverse filter is applied to the adaptable-order inverse filter in such a way that the order of the adaptable-order filter is subjected to a stepping up process from the permissible minimum value until a decrease in the error signal that is smaller than the threshold value is observed or until the largest permissible overall order of modelling $D_{MAX}$, which has been set in this method, is reached. The speech block to be coded is filtered with each inverse filter of a different order and the output power of the modelling error, i.e., of the inverse filter, is calculated for each different filtering order. When the filter structure used is a lattice filter that uses reflection coefficients, increasing the order does not change the previous filter coefficient values, i.e., increasing the order only causes adding a new filtering operation to the filter output of the shorter modelling order. In the calculations, direct use can thus be made of the calculations carried out in the smaller order filter. The operations of blocks 207 and 227, which carry out adaption of the order, differ essentially from each other. Because in the method according to FIG. 2*b* filter coefficients are not used in adapting the order of the modelling, the coder's operating mode has to be supplied to the receiver as an additional parameter, and this operating mode indicates to the decoder the order of modelling used in each speech frame that is to be processed.

FIG. 2*c* presents a simplified block diagram 241 of the method in accordance with the invention, combined with the error correction coding unit 242. In the figure, speech signal 243 undergoes calculation of the coefficients of the fixed-order model in the previously described manner and inverse filtering in block 249 as well as the corresponding adaptable-order processing in block 245. The selection of the order of the adaptable-order modelling can be carried out either on the basis of the frequency response of the low-order modelling (in the manner of the embodiment in FIG. 2*a*) or on the basis of the overall modelling error (in the model of the embodiments in FIG. 2*b*). The adaption method of the order is selected in switch 248 depending on whether the method according to FIG. 2*a* (switch 248 in position a) or FIG. 2*b* (switch 248 in position b) has been put into use. The order is selected in block 250 or 251. The method can be connected to the error correcting coding in the manner presented in FIG. 2*c* in such a way that the selected order of modelling $M_2$ is supplied not only to block 246, which performs the coding of the excitation signal, but also to the error correction unit 247. In this case it is possible not only to alter the bit rate of the coding of the excitation signal within the limits of the total modelling selected but also to adapt the bit rate that is to be used for error correction coding in block 242. The bit stream 244 to be supplied to the decoder contains the speech coder's parameters (filter coefficients and excitation signal) as well as the error correction code and data on the operating mode, i.e., on the order of the short-term filter model. Insofar as adaption of the order has been performed directly on the basis of the coefficients a(i); i=1,2, . . . $M_1$ of the fixed-order modelling (in the manner of the embodiment shown in FIG. 2*a*), these can be used to indicate the order of adaption for the coding of the excitation signal and the error correction coding, and this means that there is no need to supply separate mode data.

Figure 3:
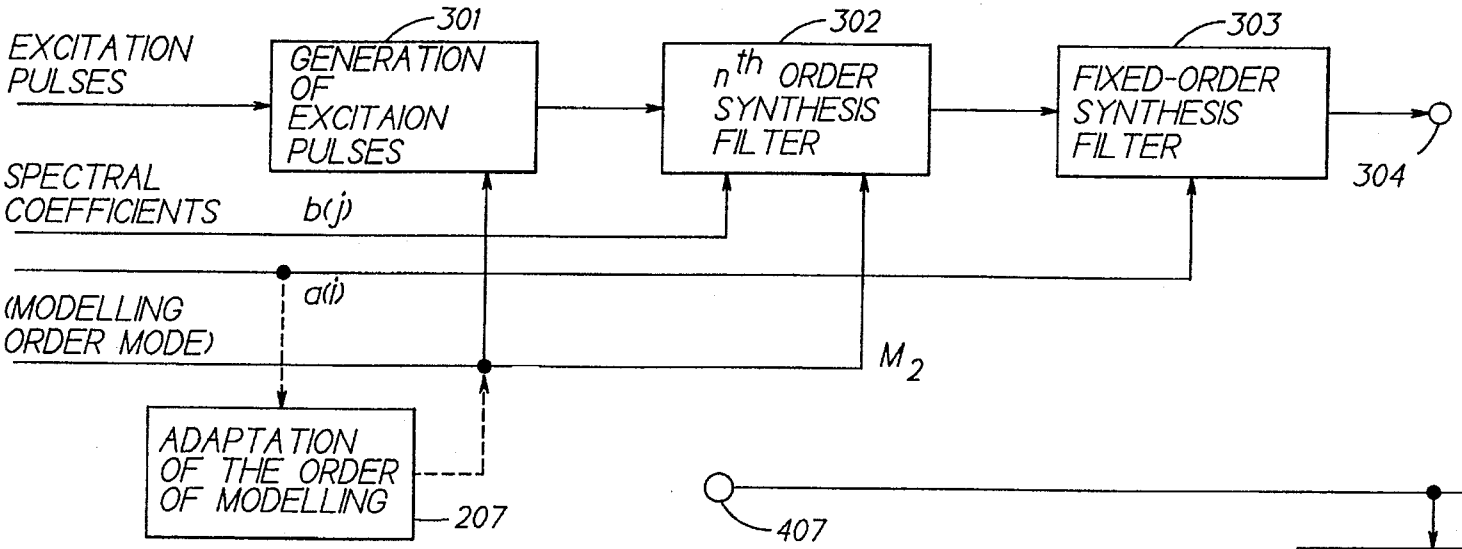
FIG. 3 presents the block diagram of a decoder corresponding to the encoder of FIG. 2*a* or 2*b*, which employ a method according to the invention.

FIG. 3 presents the block diagram of a decoder in accordance with the invention. The decoder receives data on how large an order of short-term modelling has been used in the coding. The order of modelling can be determined from a special, separately conveyed mode data idem indicating the order of modelling (a decoder corresponding to the encoder in FIG. 2*b*) or directly from the filter coefficients of the low-order modelling (a decoder corresponding to the encoder in FIG. 2*a*). FIG. 3 presents a decoder corresponding to the encoder in FIG. 2*b* and to which a signal indicating the order of modelling is supplied. In the decoder corresponding to the encoder in FIG. 2*a*, the order of modelling can be deduced from the fixed-order modelling coefficients by carrying out adaption of the degree of modelling also in the decoder according to the procedure shown in block 207. This procedure has been drawn on FIG. 3 with a dashed line. The data on the order used, i.e., the operating mode, is supplied not only to short-term synthesis filter 302 but also to block 301, which performs decoding of the excitation signal because the operation made at the same time adapts the bit rate to be used for transmitting the excitation. In the method the decided speech signal 304 is obtained from the output of low-order, short-term synthesis filter 303. The method furthermore provides for applying the modelling coefficients of both the adaptable-order, short-term modelling and the fixed-order, short-term modelling to synthesis filters 302 and 303.

In the above-described exemplary embodiments, it was discussed how a method in accordance with the invention could be applied to coding methods in which the excitation signal is formed directly from the error signal of the short-term modelling. These are surpassed in efficiency by speech coding methods based on filtering modelling in which the coding of the excitation signal is performed according to the so-called analysis-by-synthesis method. A method in accordance with the invention can also be applied to coding methods of this type as will be explained in the following.

Figure 4A:
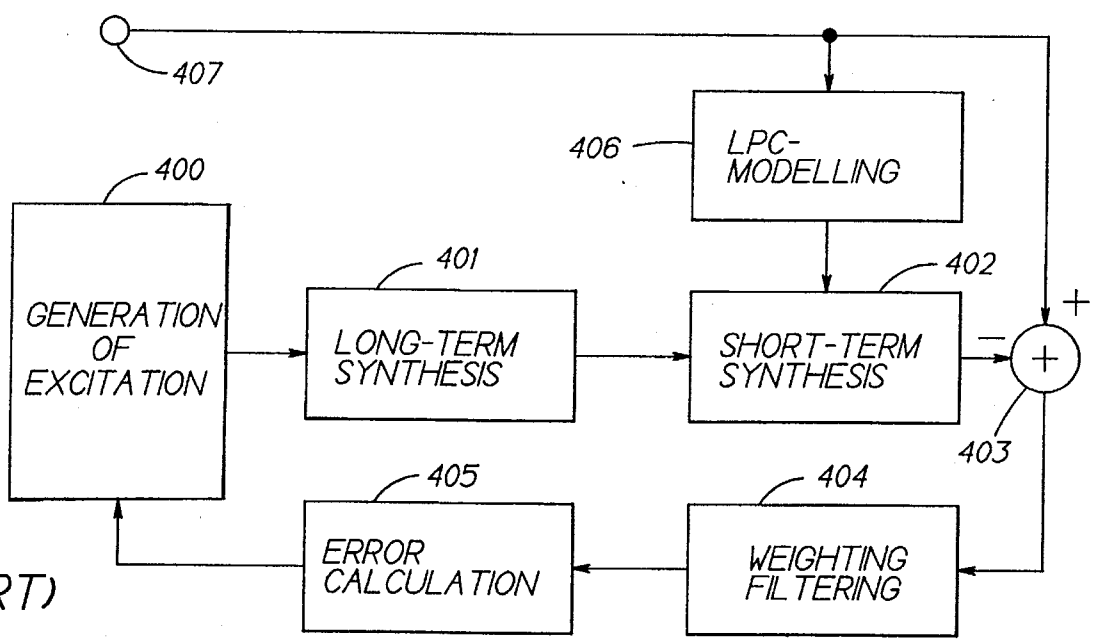
FIG. 4A (PRIOR ART)
FIG. 4*a* is a schematic diagram of the analysis-by-synthesis method known in the field, in which closed-loop optimization is used in modelling the excitation signal.

FIG. 4*a* presents a schematic block diagram of a speech coder known in the field, in which an analysis-by-synthesis method is used for coding the excitation signal. In a coding method of this kind, a search is made, in each block of the speech signal that is to be coded, for an easily conveyable format for the excitation signal, this being accomplished by synthesizing a large amount of speech signals corresponding to easily codable excitation signals and selecting the best excitation by comparing th e synthesis result with the speech signal to be coded. In this method a prediction error signal is thus not formed at all, but instead the signal to be used as an excitation is formed in excitation generation block 400. In short-term analysis block 406, the short-term filter coefficients are calculated from speech signal 407 and these are used in short-term synthesis filter 402. The excitation signal is formed by comparing the original speech signal as well as the synthesized speech signal with one another in difference calculation block 403. A synthesized speech signal for all possible excitation alternatives is obtained by shaping the excitation alternatives obtained from excitation generation block 400, each of them in long-term synthesis filter 401 and short-term synthesis filter 402. The difference signal obtained from difference calculation block 403 is weighted in weighting block 404 so that it becomes, from the standpoint of human auditory perception, a more significant measure of the subjective quality of the speech by allowing a relatively greater range of error at strong signal frequencies and less at weak signal frequencies. In error calculation block 405, a calculation is made, based on the difference signal, of a measurement value for the goodness of the synthesis result obtained by means of each excitation alternative and this is used to direct the formation of the excitation and to select the best possible excitation signal.

Figure 4B:
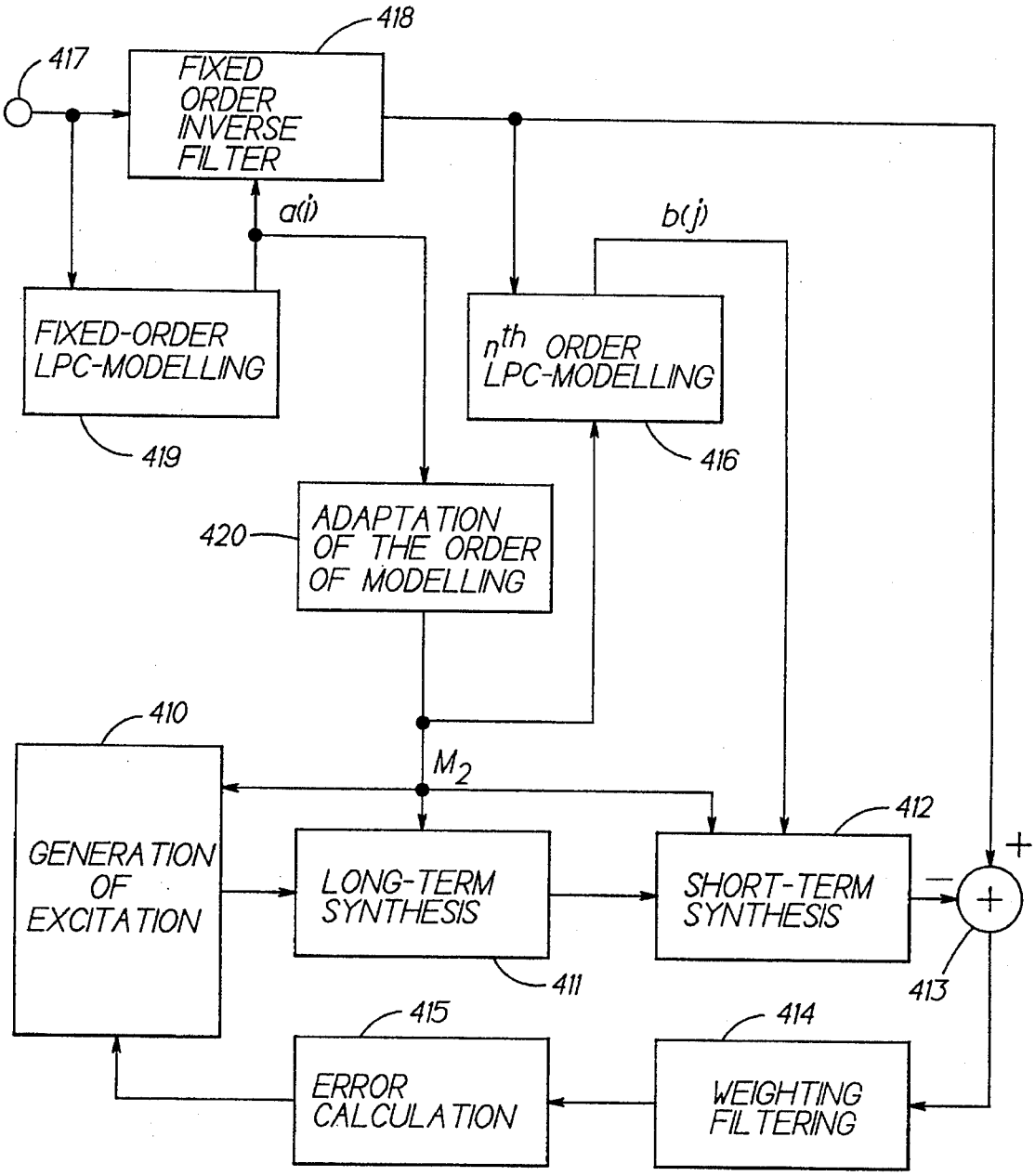
FIGS. 4*b* and 4*c* present an application of the modelling method in accordance with the invention, to speech coders operating on the analysis-by-synthesis principle.

FIG. 4*b* presents a block diagram of an application of the method to speech coders that carry out the coding of the excitation signal. The figure presents the structure of an encoder for an embodiment in which the adaption of the order is based, in a manner similar to that in the embodiment shown in FIG. 2*a*, on the modelling error signal obtained as the output of the fixed-order inverse filter. The order to be used in the adaptable-order model is obtained from block 420. Fixed-order, short-term modelling is performed on speech signal 417 in block 419. The low-order inverse filtering of the fixed modelling order according to the modelling coefficients a(i);j=1,2, . . . $M_1$ of block 419 is carried out in block 418. The inverse filtered speech signal is then run to adaptable-order modelling block 416, from which are extracted the filter coefficients b(j); j=1,2, . . . $M_2$ of the adaptable-order filter. These filter coefficients are supplied to short-term synthesis filter 412, which is located at the branch of the closed-loop search unit. In addition, the analysis-by-synthesis structure receives an indication of the order $M_2$ of the selected short-term modelling, which order is used to select the appropriate modelling order in filtering block 412. The data input on the order of modelling is also supplied to the unit which models the excitation, where it indicates how much of the bit rate has been used to transmit the coefficients of the short-term filter model and, correspondingly, how much of the bit rate is available for use in forming the excitation signal in block 410. The system furthermore makes use of a so-called long-term filtering model by carrying out, in block 411, the long-term filtering that models the spectrum's fine structure, and the bit rate of this filtering can also be adapted according to the magnitude of the short-term modelling that has been selected for use. Blocks 413, 414 and 415 carry out the same functions as blocks 403, 404 and 405 in FIG. 4*a*.

A method in accordance with the invention can also be applied to analysis-by-synthesis coders in another embodiment such that the speech signal is brought directly to signal difference element 413 without the inverse filtering 418 first being performed on it. In this case, a fixed-order synthesis filtering which is done in block 418 should also be added to the adaptable-order, short-term synthesis filtering that is to be carried out in block 412. The fixed-order and adaptable-order, short-term model can thus be combined with the speech coder either such that in the optimization of the excitation parameters only the adaptable-order synthesis filtering is carried out (as has been presented in the embodiment in FIG. 4*b*), whereby the inverse filtering corresponding to the fixed modelling belonging to the short-term modelling is carried out on the original speech signal before comparison with the synthesis result or else such that the entire short-term synthesis model, i.e., in addition to the synthesis filtering according to the adaptable-order model, also the fixed-order, short-term synthesis filtering is carried out in the coder's closed-loop branch. The procedure according to FIG. 4*b* is lower in terms of its computational load. With the method according to the invention, a reduced computational load can be achieved in this embodiment when using analysis-by-synthesis methods because only filtering of the magnitude of the order that is necessary from the standpoint of the modelling need be carried out. In the analysis-by-synthesis methods, it is precisely the filtering operations that constitute the large computational load resulting from the method.

Figure 4C:
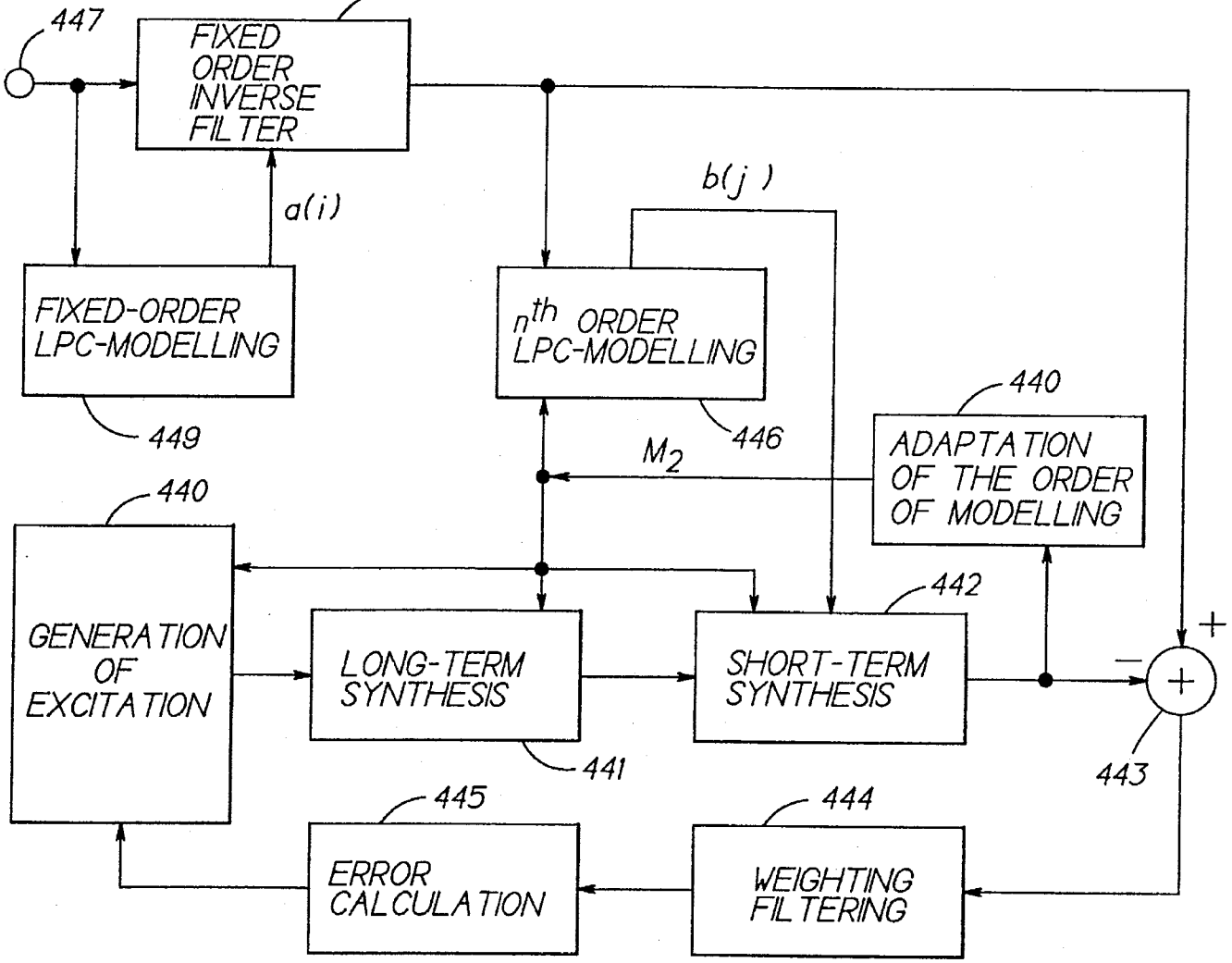

Adaption block 420 of the order of modelling, which is situated within FIG. 4*b*, carries out the same operation as adaption block 207 of the order of modelling in FIG. 2*a*. As in FIG. 2*b*, in the analysis-by-synthesis search process adaption of the order of the filter modelling can be carried out by means of the actual error signal through the use of feedback. This arrangement is presented in FIG. 4*c*. In terms of its operation, adaption block 440 of the order of modelling, shown in FIG. 4*c*, corresponds to adaption block 227 of FIG. 2*b*. Adaption of the order of the short-time filtering in accordance with FIG. 4*c* on the basis of signals synthesized with different excitation signal candidates naturally increases the compuational load of the method compared with the use of a fixed-order filtering model or a model according to FIG. 4*b*, in which the selection of the order of modelling is done before optimization of the excitation. The coder in FIG. 4*c* differs from the coder in FIG. 4*b* essentially in the respect that in the coder in FIG. 4*c* adaption of the order of the filter model has been taken to be part of the coding to be carried out by means of the analysis-by-synthesis model. In FIG. 4*c* the order of the filter is thus also selected using analysis-by-synthesis principle and the process involved in the coder is thus an extension of the carrying out of the closed-loop search from coding of the excitation signal to coding of the filter coefficients. However, this has been carried out in a very simple form, being limited only to adaption of the order of filtering. In this embodiment, too, the filter coefficients are still formed in block 446 with an open-loop search from the signal to be processed. In the embodiment in FIG. 4*c*, the analysis-by-synthesis method can be used in coding of the short term model, but at the same time the computational load resulting from the method can be kept at a moderate level.

In view of the foregoing it will be clear that modifications may be incorporated without departing from the scope of the present invention.

What we claim is:

1. A method of coding an input signal comprising a series of speech signal blocks, the method comprising the steps of:

a) developing, in a short-term analyzer, a group of prediction parameters that are characteristic of the input signal, in which in each speech signal block to be coded the prediction parameters are characteristic of the speech signal's short-term spectral content;

b) forming an excitation signal which, when fed to a synthesis filter operating in accordance with the prediction parameters, results in the synthesis of a coded speech signal corresponding to the input signal;

c) the step of developing including a preliminary step of forming a short-term filtering model from two components, one of the two components being a fixed-order, short-term filtering model component with low model order and the other one of the two components being a variable-order, short-term filtering model component with a high model order;

d) the step of developing including the steps of, calculating short-term prediction parameters for both components;

e) adapting a total order of the short-term filtering model in each speech block to be coded, in accordance with the speech signal; and f) adapting a bit rate used for coding the prediction parameters and a bit rate used for coding the excitation signal in such a manner that increasing the order increases the bit rate used for coding the prediction parameters and, correspondingly, reduces the bit rate used for coding the excitation signal.

2. A method as claimed in claim 1, wherein a calculation of filter coefficients of the fixed-order, short-term filtering model component is carried out directly from the speech signal that is inputted for coding, whereas the filter coefficients of the variable-order short-term filtering model component are calculated from a signal which is obtained by filtering the speech signal which is inputted for coding by means of an inverse filter of the fixed-order short term filtering model component.

3. A method as claimed in claim 1, wherein an output of the low-order fixed-order filtering model component is used to adapt the order of the variable-order, short-term filtering model component such that the order of the variable-order, short-term filtering model component is calculated to be small if a largest part of the energy in the signal block to be coded is in the high frequencies according to the fixed-order, short-term filtering model component.

4. A method as claimed in claim 1, wherein the step of adapting the total order is performed according to a prediction error of the total order of the short-term filtering model through the use of feedback by comparing an effect of increasing the order of modelling with a magnitude of the prediction error.

5. A method as claimed in claim 4, wherein the order of modelling is increased until a reduction in the power of the prediction error is smaller than a given threshold value or until the order of modelling reaches a largest permissible order of modelling.

6. A method as claimed in claim 1, wherein in the fixed-order, short-term filtering model component a lower adaption frequency of the model parameters is used than in the variable-order, short-term filtering model component and is used to convey spectral characteristics resulting from the speaker and the microphone, which change more slowly than phonic information that is modelled in the variable-order, short-term filtering model component.

7. A method as claimed in claim 1, wherein speech coding is performed using analysis-by-synthesis by combining the short-term filtering model with the speech coding such that in a closed-loop optimization of the excitation parameters, variable-order synthesis filtering alone is carried out, in which case inverse filtering corresponding to the fixed-order, short-term filtering model is carried out on the original speech signal before comparison with a result of synthesis, that is, in addition to the synthesis filtering according to the variable-order filtering model also the fixed-order, short-term synthesis filtering is carried out in a branch of the speech coding that carries out the selection of the excitation signal.

8. A method as claimed in claim 1, wherein the adaption of the total order of the short-term filtering model is carried out as part of a coding method which is performed by an analysis-by-synthesis method by using the analysis-by-synthesis method to search for a filter order from which filter order level further increases in the order do not substantially improve the quality of the speech signal.

9. A method as claimed in claim 1, wherein the total order of modelling is transmitted not only to a block carrying out coding of the excitation signal but also to a block carrying out error correction coding, such that in addition to the bit rate of the coding of the excitation signal, the bit rate used for error correction coding is made adaptive.

10. A speech coder for coding an input speech signal that is partitioned into a series of speech signal blocks, comprising:

a short-term analyzer having an input coupled to the input signal for coding and outputting a group of prediction parameters that are characteristic of the input speech signal, in which each speech signal block the prediction parameters are characteristic of a spectral content of the speech signal; and means for coding and outputting an excitation signal which, when received by a speech decoder that also receives the coded prediction parameters, results in the synthesis of a synthesized speech signal that corresponds to the input signal;

said short-term analyzer including a short-term filtering model comprised of two components, one of the two components being a fixed-order, short-term filtering model component with low model order and the other one of the two components being a variable-order, short-term filtering model component with a high model order, said short-term analyzer further including, means for calculating the short-term prediction parameters for both components;

means for adapting a total order of the short-term filtering model in accordance with a spectral content of the speech signal; and means for adapting a rate at which the prediction parameters are coded and a rate at which the excitation signal is coded in such a manner that increasing the total order increases the prediction parameter coding rate while decreasing the excitation signal coding rate.

11. A speech coder as set forth in claim 10, wherein a signal indicative of the total order is also output to the speech decoder.

12. A speech coder as set forth in claim 11, and further comprising an error correction coder interposed between said speech coder and said speech decoder; and wherein a bit rate of said error correction coder is varied in accordance with said signal that is indicative of the total order.

13. A speech coder as set forth in claim 10, wherein said short-term analyzer is further comprised of an analysis-by-synthesis analyzer.

14. A speech coder for coding an input speech signal that is partitioned into a series of speech signal blocks, comprising:

a short-term analyzer having an input coupled to the input signal for coding and outputting a group of prediction parameters that are characteristic of the input speech signal, in which in each speech signal block the prediction parameters are characteristic of a spectral content of the speech signal; and means for coding and outputting an excitation signal which, when received by a speech decoder that also receives the coded prediction parameters, results in the synthesis of a synthesized speech signal that corresponds to the input signal;

said short-term analyzer including a short-term filtering model comprised of two components, one of the two components being a fixed-order, short-term filtering model component with low model order and the other one of the two components being a variable-order, short-term filtering model component with a high model order, said short-term analyzer further including, means for calculating short-term prediction parameters for both components;

means for adapting a total order of the short-term filtering model in accordance with a change in a prediction error value resulting from a change in the order; and means for adapting a rate at which the prediction parameters are coded and a rate at which the excitation signal in coded in such a manner that increasing the total order increases the prediction parameter coding rate while decreasing the excitation signal coding rate.

15. A speech coder as set forth in claim 14, wherein said means for adjusting increases the order until one of (1) a decrease is observed in the prediction error value and (2) the order is increased to predetermined maximum value.

* * * * *

UNITED STATES PATENT AND TRADEMARK OFFICE

CERTIFICATE OF CORRECTION

PATENT NO. : 5,596,677

DATED : January 21, 1997

INVENTOR(S) : Jarvinen, et. al.

It is certified that error appears in the above-indentified patent and that said Letters Patent is hereby corrected as shown below:

Title page, item [73], Assignee: should read--Nokia Mobile Phones Ltd., Finland, Nokia Telecommunications OY, Espoo, Finland--.

Signed and Sealed this

Twenty-first Day of October 1997

*Attest:*

*Attesting Officer*

BRUCE LEHMAN

*Commissioner of Patents and Trademarks*